US005255651A

United States Patent [19]

Wakasa et al.

[11] Patent Number: 5,255,651

[45] Date of Patent: Oct. 26, 1993

[54] GOVERNOR FOR FUEL INJECTION SYSTEM

[75] Inventors: Satoshi Wakasa; Toru Okazaki, both of Oyama, Japan

[73] Assignee: Kabushiki Kaisha Komatsu Seisakusho, Tokyo, Japan

[21] Appl. No.: 826,188

[22] Filed: Jan. 23, 1992

Related U.S. Application Data

[63] Continuation of Ser. No. 689,733, Apr. 24, 1991, abandoned, which is a continuation of Ser. No. 50,279, Jun. 30, 1987, abandoned.

[30] Foreign Application Priority Data

Sep. 13, 1985 [JP] Japan ..... 60-139398

[51] Int. Cl.[5] ..... F02D 31/00

[52] U.S. Cl. ..... 123/357; 123/385; 123/198 D

[58] Field of Search ..... 123/357, 358, 359, 385, 123/386, 387, 198 D, 479

[56] References Cited

U.S. PATENT DOCUMENTS 3,614,946 10/1971 Standt ..... 123/387

3,724,430 4/1979 Adler ..... 123/357

FOREIGN PATENT DOCUMENTS 1345467 1/1974 Fed. Rep. of Germany ..... 123/385

2741834 3/1979 Fed. Rep. of Germany ..... 123/387

*Primary Examiner*—Carl S. Miller

*Attorney, Agent, or Firm*—Armstrong, Westerman, Hattori, McLeland & Naughton

[57] ABSTRACT

A hydraulic-controlled electronic governor employed in a fuel injection system is provided with a proportional pressure-reducing solenoid valve (10) capable of conducting a self-regulation of an input hydraulic pressure supplied from a hydraulic pressure source (30). Such pressure-reducing solenoid valve (10) is connected with a control rack (25) for controlling an amount of fuel injection, while interposed between the hydraulic pressure source (30) and a pressure input chamber (28) of a power piston/cylinder mechanism (22) for controlling the control rack (25), so that the input hydraulic force acting on one side of the piston (24) of the power piston/cylinder mechanism (22) balances the resilient force of a return spring (27) acting on the other side of such piston (24) so as to control the control rack (25) in its position.

4 Claims, 3 Drawing Sheets

GOVERNOR FOR FUEL INJECTION SYSTEM

This application is a continuation of application Ser. No. 689,733 filed Apr. 24, 1991, now abandoned which is continuation of application Ser. No. 050,279 filed Jun. 30, 1987, now abandoned.

BACKGROUND OF THE INVENTION

1. Field of the Invention

The present invention relates to a governor for an internal combustion engine, and more particularly to a hydraulic-controlled electronic governor employed in a fuel injection system for a Diesel engine.

2. Description of the Prior Art

Hitherto, in this type of the governor, a Bosch-type governor shown in FIG. 1 of the accompanying drawings is well known. In the Bosch-type governor, as shown in FIG. 1, a solenoid valve 1 is controlled to be turned on or off by a controller C, to cause a valve spool 2 to be operated, whereby a hydraulic pressure fed to a power piston/cylinder unit 3 is controlled. The thus controlled hydraulic pressure moves a control rack 4 to a position in which a resilient force of a return spring 5 balances a hydraulic force acting on a piston 3*a* of the power piston/cylinder unit 3. A rack position detecting sensor 6 detects such movement of the control rack 4 to issue a detecting signal to the controller C so as to constitute a feedback control for controlling the position of the control rack 4.

Incidentally, in addition to such detecting signal issued from the rack position detecting sensor 6, the controller C receives also other sensor's signals as to an inclination angle of an accelerator lever (not shown), an engine speed and the like. The reference numeral 7 denotes a gear pump which serves as a hydraulic pressure source.

In the above-mentioned conventional governor, in controlling a position of the control rack 4 for controlling an amount of fuel injection according to traveling conditions of a vehicle and loading conditions of the same, the rack position detecting sensor 6 constitutes an indispensable component of the governor, so that the governor does not function when some malfunction occurs in the sensor 6 itself or in a detecting signal transmitting path between the sensor 6 and the controller C.

SUMMARY OF THE INVENTION

The present invetion is made in consideration of the above problem inherent in the conventional governor, and, therefore, it is an object of the present invention to provide a governor employed in a fuel injection system, which governor makes it possible that the control rack is controlled by a provision of a proportional pressure-reducing solenoid valve even when some malfunction occurs in the rack position detecting sensor or in the detecting signal transmitting path thereof, which solenoid valve is interposed between a pressure input chamber of a power piston/cylinder mechanism and a hydraulic pressure source and may be self-regulated in input-pressure.

In order to accomplish the above object of the present invention, according to the present invention, there is provided: a governor for a fuel injection system, comprising a proportional pressure-reducing solenoid valve which is interposed between a hydraulic pressure source and a pressure input chamber of a power piston/cylinder mechanism connected to a control rack for controlling an amount of fuel injection so as to control said control rack in operation, said proportional pressure-reducing solenoid valve being self-regulated in input pressure of a hydraulic pressure fed from said hydraulic pressure source to said pressure input chamber of said power piston/cylinder mechanism, whereby said control rack is controlled in its position by balancing a hydraulic pressure acting on one side of a piston of said power piston/cylinder mechanism against a resilient force of a return spring acting on the other side of said piston of said power piston/cylinder mechanism.

It is easy for anyone skilled in the art to understand other objects of the present invention together with advantages and embodiments thereof, from the following description with reference to the accompanying drawings.

DESCRIPTION OF THE PREFERRED EMBODIMENT

A preferred embodiment of the present invention will be hereinbelow described with reference to FIGS. 2 to 4 of the drawings.

Figure 1:
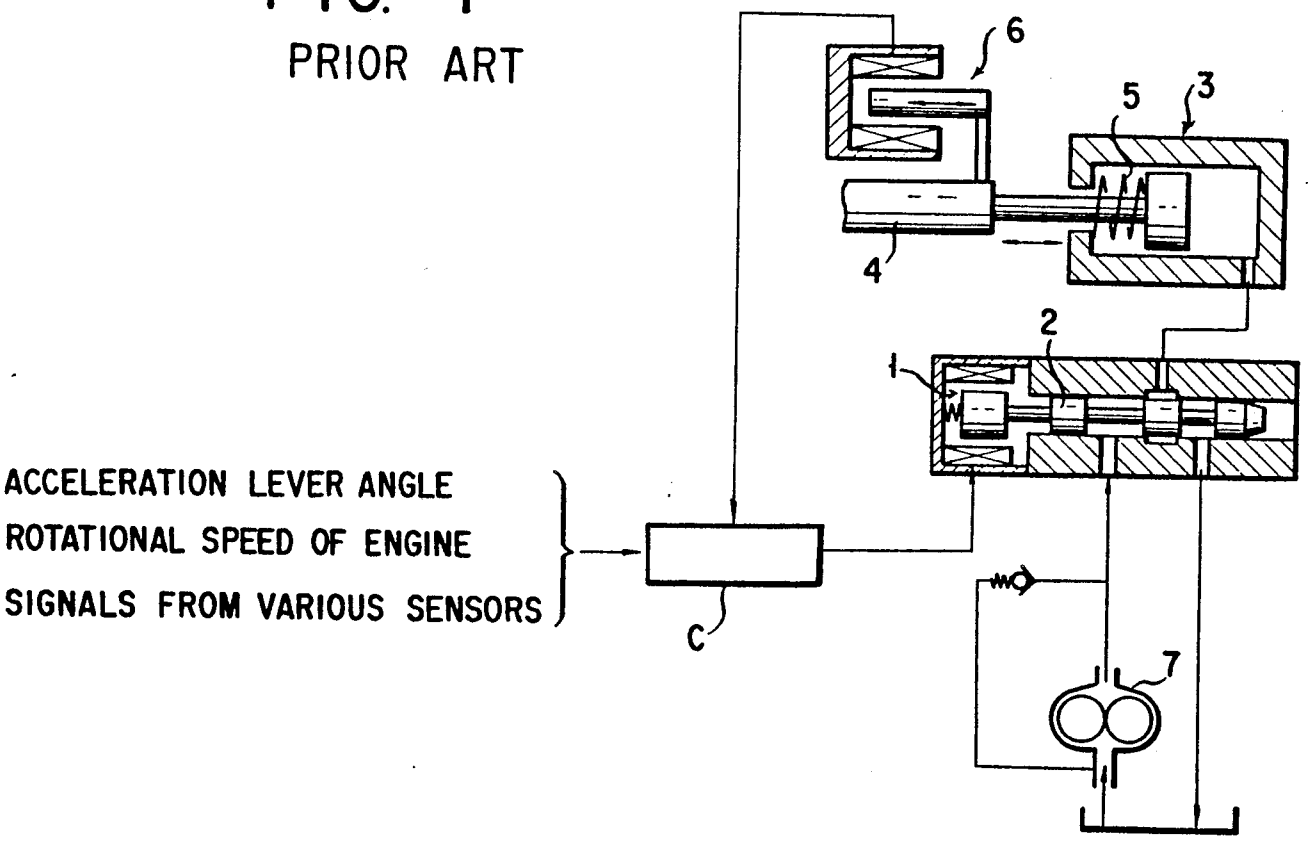
FIG. 1 PRIOR ART
FIG. 1 is a schematic view of the governor employed in the conventional fuel injection system.
Figure 2:
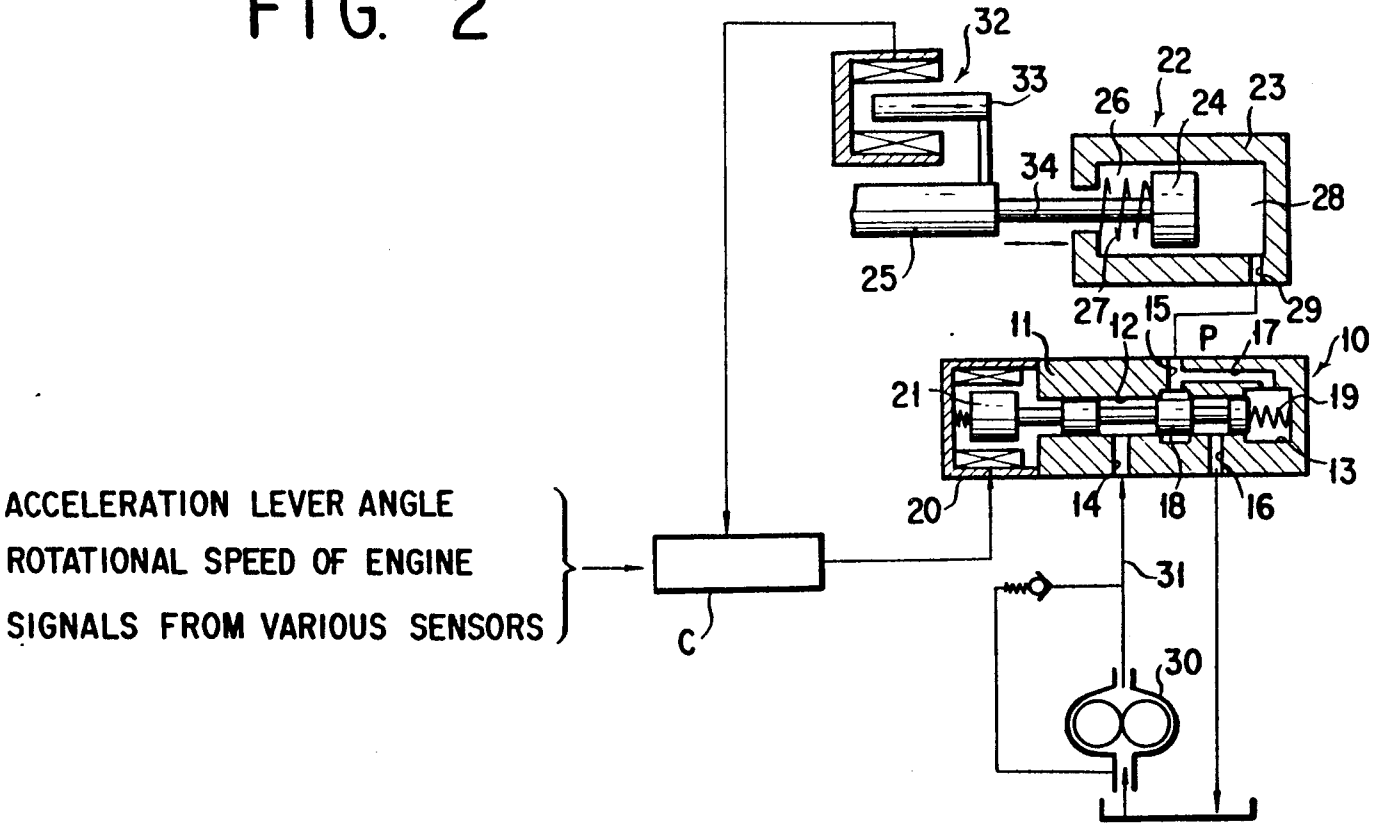
FIG. 2 is a schematic view of an embodiment of the governor of the present invention.

As shown in FIG. 2, the reference numeral 10 denotes a proportional pressure-reducing solenoid valve provided with a valve body 11 which comprises: a valve bore 12 in its substantially central portion; and a pressure chamber 13 in its one end portion. Further, in the valve body 11 are provided: a pump port 14; a output port 15; and a drain port 16. The output port 15 communicates with the pressure chamber 13 through a passage 17. In the valve bore 12 is slidably received a spool 18 which is provided in the pressure chamber 13 and urged by a spring 19 interposed between a bottom surface of the pressure chamber 13 and one end surface of the spool 18.

In the other end portion of the valve body 11 opposite to the pressure chamber 13, there is provided a solenoid 20 a movable element 21 of which is integrally connected with the spool 18.

Further, as shown in FIG. 2, the reference numeral 22 denotes a power piston/cylinder mechanism provided with a cylinder 23 and a piston 24 slidably received in the cylinder 23. To this piston 24 is connected a rod 34 connected with a control rack 25 for controlling an amount of fuel injection. In addition, a pressure input chamber 28 is formed in the power piston/cylinder mechanism 22 at one side of the piston 24 thereof, i.e., at a head side of the cylinder 23, which chamber 28 communicates with the output port 15 of the proportional pressure-reducing solenoid valve 10 through a passage 29. On the other hand, at the other side of the piston 24, i.e., at a rod side of the piston 24 in the power piston/cylinder mechanism 22, there is formed a chamber 26 for receiving a return spring 27.

The pump port 14 of the proportional pressure-reducing solenoid valve 10 is connected with an outlet passage 31 of the gear pump 30 which serves as a hydraulic pressure source.

On the other hand, a movable element 33 of a rack position detecting sensor 32 is connected with the control rack 25 for issuing a detecting signal after detecting the movement of the control rack 25 by means of the rack position detecting sensor 32, which detecting signal is supplied to a controller C to constitute a feedback control. In the controller C are inputted various sensors' signals as to an inclination angle of an acceleration lever (not shown), an engine speed and the like.

Now, the operation or the embodiment of the present invention shown in FIG. 2 will be described as follows:

Upon receipt of a signal issued from the rack position detecting sensor 32 and other various sensors' signals as to an inclination angle of an acceleration lever, an engine speed and the like, the controller C is operated to issue an output signal to the solenoid 20 so as to actuate the same 20, so that the movable element 21 of the solenoid 20 is moved, whereby the spool 18 of the proportional pressure-reducing solenoid valve 10, which spool 18 is connected with such movable element 21, is moved to cause the pump port 14 to communicate with the output port 15. As a result, a hydraulic pressure is supplied from the gear pump 30 to the pressure input chamber 28 of the power piston/cylinder mechanism 22, so that the control rack 25 is moved to a position in which a hydraulic force acting on the piston 24 balances the resilient force of the return spring 27. The rack position detecting sensor 32 detects such movement of the control rack 25 to issue a detecting signal to the controller C so as to constitute a feedback control.

In case that some malfunction occurs in the rack position detecting sensor 32 or the signal transmitting path thereof, since the hydraulic pressure received in the pressure input chamber 28 of the power piston/cylinder mechanism 22 acts on the pressure chamber 13 of the proportional pressure-reducing solenoid valve 10 through the passage 17, both of the hydraulic force developed in the pressure chamber 13 and the resilient force of the spring 19 form a leftward force acting on one end of the spool 18 to cause the spool 18 to move leftward in FIG. 2, while an electromagnetic force developed in the solenoid 20 forms a rightward force acting on the other end of the spool 18 through its movable element 21 so as to move the spool 18 rightward in FIG. 2, whereby the spool 18 is moved to a position in which the above-mentioned leftward force balances such rightward force, so that a hydraulic pressure proportional to such position is supplied to the power piston/cylinder mechanism 22. As a result, the control rack 25 is moved to a position in which such hydraulic pressure balances the resilient force of the return spring 27. Consequently, it is possible to control the control rack 25 even if some malfunction occurs in the race position detecting sensor 32 or in its detecting signal transmitting path.

Figure 3:
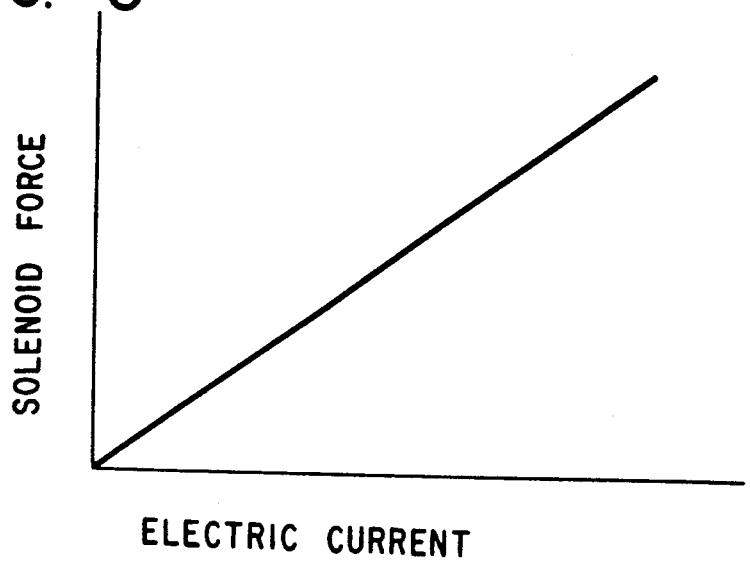
FIG. 3 is a diagram illustrating a relationship between an electromagnetic force developed in the solenoid of the proportional pressure-reducing solenoid valve employed in the governor of the present invention and an electric current supplied to the solenoid.
Figure 4:
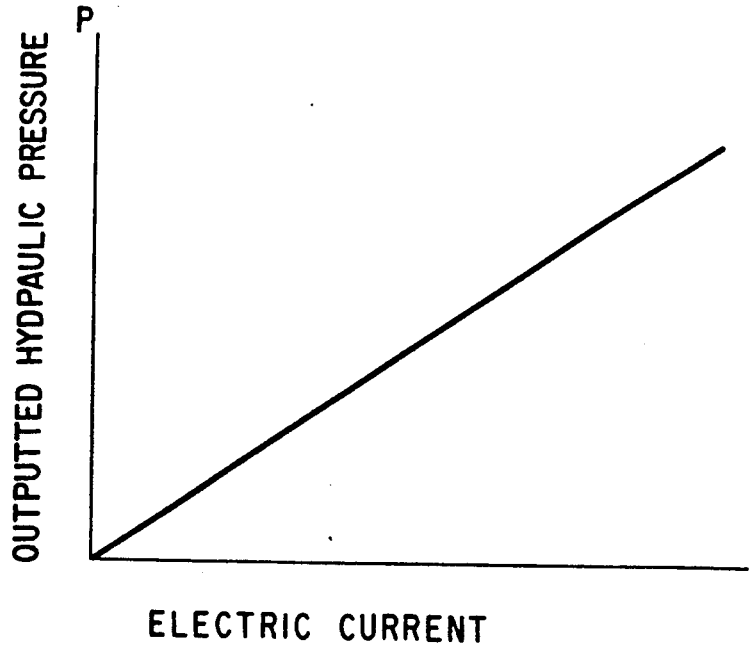
FIG. 4 is a diagram illustrating a relationship between an output hydraulic pressure of the proportional pressure-reducing solenoid valve employed in the governor of the present invention and the electric current supplied to the solenoid of the proportional pressure-reducing solenoid valve.

Incidentally, as shown in FIG. 3, since the electromagnetic force developed in the solenoid 20 is proportional to the electric current supplied thereto, the output hydraulic pressure P controlled by the proportional pressure-reducing solenoid valve 10 is also proportional to such electric current as shown in FIG. 4.

The above description relates only to the preferred embodiment of the present invention, so that the scope of the present invention is not limited only to such embodiment. In addition, it is clearly understood for anyone skilled in the art to easily modify the embodiment in various ways without separating from the spirit of the present invention.

What is claimed is:

1. A governor control apparatus for a fuel injection system comprising:

a control rack by which movement an amount of fuel injection is controlled;

a power piston/cylinder mechanism connected to said control rack so as to control the movement of said rack and having a piston connected to said rack, a pressure input chamber on one side of said piston;

rack position detecting sensor producing a signal and being operatively associated with said control rack;

control means for controlling a supply of hydraulic fluid under pressure from a hydraulic pressure source to the pressure input chamber of said power piston/cylinder mechanism;

a controller receiving said signal from said rack position detecting sensor and connected to said control means for actuating the same according to said signal so as to control the position of said control rack by varying hydraulic pressure within said pressure input chamber; and a proportional pressure control solenoid valve incorporated in said control means, interposed between said hydraulic pressure source and said pressure input chamber and being capable of conducting a self-regulation of an input hydraulic pressure applied to said pressure input chamber, said proportional pressure control solenoid valve being capable of independent said pressure control irrespective of said signal from said rack position sensor so that even when some malfunction occurs in said rack position detecting sensor or in the detecting signal transmitting path thereof, said control rack can be controlled by a provision of said proportional pressure control solenoid valve.

2. A fuel injection control system for a diesel engine for injecting a controlled amount of fuel for combustion in a combustion chamber, wherein a governor control apparatus comprising:

a primary fuel injection control system including a fuel metering member movably disposed in said governor for adjusting flow rate of the fuel flowing therethrough for controlling injection amount of the fuel;

a hydraulic position control means associated with said fuel metering member for actuating the later to a position corresponding to a desired fuel injection amount which is determined on the basis of an engine output demand;

a sensor means for monitoring the position of said fuel metering member and producing a monitored position indicative signal;

an electrically controlled pressure supply control means for adjusting pressure supply for said hydraulic position control means according to an electric control signal supplied thereto;

a controller means for receiving said monitored position indicative signal for generating said control signal on the basis of said monitored position indicative signal and said engine output demand for positioning said fuel metering member at the position corresponding to a demanded fuel injection amount; and an auxiliary control system incorporated in said electrically operable controlled pressure supple means and normally cooperated with said primary control system for controlling position of said fuel metering member to the position corresponding to the demanded fuel injection amount, and said auxiliary control system in response to failure of said primary control system for independently controlling the pressure supply for said hydraulic position control means for positioning said fuel metering member at a controlled position.

3. A fuel injection control system for a diesel engine for injecting a controlled amount of fuel for combustion in a combustion chamber, wherein a governor control apparatus comprising:

a fuel metering member movably disposed in said governor for adjusting flow rate of the fuel flowing therethrough for controlling injection amount of the fuel;

a hydraulic position control means associated with said fuel metering member for actuating the later to a position corresponding to a desired fuel injection amount which is determined on the basis of an engine output demand;

a sensor means for monitoring the position of said fuel metering member and producing a monitored position indicative signal;

an electrically controlled pressure supply control means for adjusting pressure supply for said hydraulic position control means according to an electric control signal supplied thereto, said electrically controlled pressure supply control means including an electrically operable actuator for driving said fuel metering member at the position corresponding to an externally input engine output demand;

a controller means for receiving said monitored position indicative signal for generating said control signal on the basis of said monitored position indicative signal and said engine output demand for positioning said fuel metering member at the position corresponding to a demanded fuel injection amount in a normal state, said controller being responsive to absence of said monitored position indicative signal for generating said control signal on the basis of said engine output demand.

4. A fuel injection control system for a diesel engine for injecting a controlled amount of fuel for combustion in a combustion chamber, wherein a governor control apparatus comprising:

a fuel metering member movably disposed in said governor for adjusting flow rate of the fuel flowing therethrough for controlling injection amount of the fuel;

a hydraulic position control means associated with said fuel metering member for actuating the later to a position corresponding to a desired fuel injection amount which is determined on the basis of an engine output demand;

a sensor means for monitoring the position of said fuel metering member and producing a monitored position indicative signal;

an electrically controlled pressure supply control means for adjusting pressure supply for said hydraulic position control means according to an electric control signal supplied thereto, said electrically controlled pressure supply control means including an electrically operable actuator for driving said fuel metering member at the position corresponding to an externally input engine output demand;

a controller means for receiving said monitored position indicative signal for normally performing feedback control of position of said fuel metering member and generating said control signal on the basis of said monitored position indicative signal and said engine output demand for positioning said fuel metering member at the position corresponding to a demanded fuel injection amount in a normal state, said controller being responsive to absence of said monitored position indicative signal for changing over operational mode into an open loop control for generating said control signal on the basis of said engine output demand.

* * * * *